United States Patent [19]

Frey

[11] 4,185,263

[45] Jan. 22, 1980

[54] WIRE-WOUND RESISTOR

[75] Inventor: Robert L. Frey, Frankfort, Ind.

[73] Assignee: P. R. Mallory & Co. Inc., Indianapolis, Ind.

[21] Appl. No.: 926,437

[22] Filed: Jul. 20, 1978

[51] Int. Cl.[2] ..... H01C 3/18

[52] U.S. Cl. ..... 338/301; 338/160; 338/334

[58] Field of Search ..... 338/301, 302, 160, 332, 338/334, 270, 296, 299, 260, 261, 267, 320, 322, 323, 325, 329, 218; 29/610

[56] References Cited

U.S. PATENT DOCUMENTS

| | | | |
|---|---|---|---|
| 947,247 | 1/1910 | Lightfoot | 338/261 X |
| 1,904,487 | 4/1933 | Lyon et al. | 338/299 |
| 2,039,974 | 5/1936 | Mucher | 338/299 |
| 2,487,064 | 11/1949 | Marsh | 29/610 |
| 2,643,316 | 6/1953 | Glasgow | 338/302 X |

*Primary Examiner*—C. L. Albritton

*Attorney, Agent, or Firm*—Hoffmann, Meyer & Coles

[57] ABSTRACT

A wire-wound resistor has an adhesive applied to the wire and the insulative substrate upon which the wire is wound at a predetermined location. The wire is then cut or otherwise broken at that location to open-circuit the resistor. The adhesive holds the cut end of the wires in place on the substrate.

12 Claims, 3 Drawing Figures

WIRE-WOUND RESISTOR

BACKGROUND OF THE INVENTION

Generally speaking, the present invention relates a method of open circuiting a variable wire wound resistance element which comprises applying a wire in a number of turns to a length of insulative strip to provide a resistance element; applying an adhesive to a side of the resistance element not to be in contact with an electrical contact so as to bond the wire to said electrically insulative strip at a predetermined location; and severing at least one turn of the turns of wire at the predetermined location to open circuit the resistance element.

This invention pertains to variable wire wound resistors and more particularly to a method of open circuiting such resistors.

Wire wound resistors are used extensively as potentiometers or rheostats to provide a means of varying electrical power in electrical circuits. For the most part the resistors are manufactured by machine wrapping the wire around a strip or electrically insulative base for an extended length. The length of wound wire is then cut into shorter lengths and electrical terminals applied to the shorter lengths. Many times, however, a customer may desire a length that is shorter than that available. In such instances, the supplier must find a way of shortening the effective length of the resistor.

One prior art method of shortening the length was to apply an electrically insulative material, such a suitable plastic, over the length of wire not needed. However, this method has been found to be unacceptable since the plastic would break off leaving exposed wire. It would be far better to provide a more positive means of shortening the effective length of the resistor.

OBJECTS OR FEATURES OF THE INVENTION

It is therefore a feature of the invention to provide a positive method of shortening the effective length of a variable wire wound resistor. Another feature of the invention is to provide such a method wherein the wire wound resistor is open-circuited. Another feature of the invention is to provide such a method wherein at least one of the turns of wire is cut or otherwise broken to provide a break in the wire. Still another feature of the invention is to provide such a method whereby the cut ends of the wire are bonded to an electrically insulative strip upon which the wire is wound. Another feature of the invention is to provide an article produced by the method. These and other features of the invention will become apparent from the following description taken in conjunction with the accompanying drawings.

DESCRIPTION OF THE PREFERRED EMBODIMENT OF THE INVENTION

Figure 2:
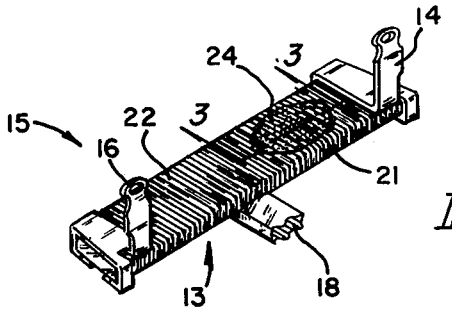
FIG. 2 is an isometric view illustrating a completed wire wound resistor made according to the present invention.

Referring now to the drawings, a variable wire wound resistor is, for the most part, manufactured by applying a number of turns of wire 10 about an electrically insulative strip 12 for an extended length of the strip to provide a resistance element 13. A suitable material for wire 10 would be a copper-nickel or nickel-chromium alloy, for example, and for the insulative strip 12 Teflon would be suitable. While a more or less rectangular strip is illustrated it should be understood that other shapes may be used.

Figure 3:
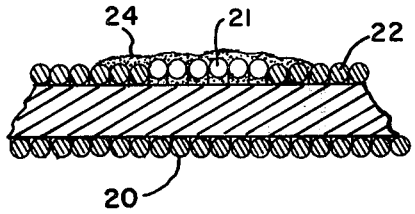
FIG. 3 is a section taken along the line 3—3 of FIG. 2, enlarged for clarity.
Figure 1:
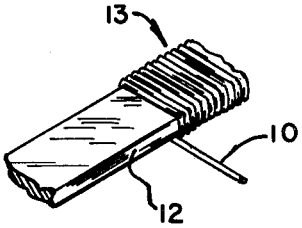
FIG. 1 is an isometric view illustrating a stage of manufacturing a variable wire wound resistor.

Referring to FIG. 2, after the wire has been applied to the insulative strip, the strip and the wire are cut to a predetermined length and electrical terminals 14 and 16 applied to the ends to provide a variable resistor 15. An electrical contact arm 18 slides along a side 20 (FIG. 3) of the resistor to provide a variable output.

As previously noted, there are many times when a length shorter than the length of the resistor illustrated in FIG. 2 is desired. To this end, as illustrated in FIG. 2, at least one turn of the wire is cut at a predetermined location to provide a break 21 in the length of wire. Thus there are two effective working lengths on either ends of the break between either of the electrical terminals. As shown, the cut is made on the side 22 opposite the working side 20 which electrical contact 18 engages and the cut is preferably made normal to the wire length and parallel to the longitudinal axis of the resistance element 13.

Prior to cutting the length of wire, an adhesive 24 is applied to the wire and the insulative strip to bond the wire to the strip. A suitable adhesive would be a laquer such as Glyptal laquer manufactured by General Electric Company. It is applied as a paint by brushing, for example. The bonding of the wire is the insulative strip bonds the loose cut ends to the strip. If desired, a suitable tape may be applied to the break 21 to further insure that the wire will remain in place.

What is claimed is:

1. A method of open circuiting a wire wound resistance element comprising:

(a) applying a wire in a number of turns to a length of electrically insulative strip to provide said wire wound resistance element, (b) applying an adhesive to a side of said resistance element not to be in contact with an electrical contact so as to bond said wire to said electrically insulative strip at a predetermined location, and (c) severing at least one turn of said turns of wire at said predetermined location to open circuit said resistance element.

2. A method according to claim 1 wherein said at least one turn is severed by cutting the wire parallel to the longitudinal axis of the resistance element.

3. A method according to claim 1 wherein said adhesive is a laquer material.

4. A method according to claim 3 wherein said laquer is applied as a paint.

5. A method according to claim 1 further including the step of applying electrical terminals to the ends of said wire.

6. A method according to claim 1 wherein said wire is taken from the group of materials consisting essentially of a copper-nickel and nickel-chromium alloy.

7. A wire wound variable resistor comprising:

(a) an electrically insulative strip, (b) a wire wound about said electrically insulative strip for a number of turns to provide a resistance element, and electrical terminals at opposed ends of said wire, (c) at least one turn of wire bonded to said electrically insulative strip at a predetermined location between said electrical terminals, (d) a break in said at least one turn of wire at said predetermined location to open circuit said wire wound resistor, and (e) an electrical contact engaging said wire between said break and one of said electrical terminals.

8. A wire wound variable resistor according to claim 7 wherein said break is a cut across at least one of said number of turns.

9. A wire wound variable resistor according to claim 8 wherein said cut is substantially parallel to the longitudinal length of said variable resistor.

10. A wire wound variable resistor according to claim 7 wherein said one turn of wire is bonded to said electrically insulative strip by an adhesive.

11. A wire wound variable resistor according to claim 10 wherein said adhesive is a laquer.

12. A wire wound variable resistor according to claim 7 wherein said wire is taken from the group consistng essentially of a copper-nickel alloy and a nickel-chromium alloy.

* * * * *